US009038555B2

(12) United States Patent
Templeman

(10) Patent No.: US 9,038,555 B2
(45) Date of Patent: May 26, 2015

(54) ADJUSTABLE SKEG

(71) Applicant: Marine Dynamics, Inc., Lenexa, KS (US)

(72) Inventor: Jon C. Templeman, Lenexa, KS (US)

(73) Assignee: Marine Dynamics, Inc., Lenexa, KS (US)

( * ) Notice: Subject to any disclaimer, the term of this patent is extended or adjusted under 35 U.S.C. 154(b) by 27 days.

(21) Appl. No.: 13/645,220

(22) Filed: Oct. 4, 2012

(65) Prior Publication Data

US 2013/0084762 A1 Apr. 4, 2013

Related U.S. Application Data

(60) Provisional application No. 61/543,052, filed on Oct. 4, 2011.

(51) Int. Cl.

| | |
|---|---|
| ***B63B 3/38*** | (2006.01) |
| ***B63H 20/34*** | (2006.01) |
| *B63H 20/12* | (2006.01) |

(52) U.S. Cl.

CPC ..... *B63H 20/34* (2013.01); *B63H 20/12* (2013.01)

(58) Field of Classification Search

USPC ..... 440/53; 114/128–143; 441/74

See application file for complete search history.

(56) References Cited

U.S. PATENT DOCUMENTS

| | | | | |
|---|---|---|---|---|
| 4,493,665 | A * | 1/1985 | Liddle | 441/79 |
| 4,733,496 | A * | 3/1988 | Wallner | 441/79 |
| 6,155,894 | A * | 12/2000 | Allison | 440/71 |
| 2003/0036322 | A1 * | 2/2003 | Wilson | 441/64 |

* cited by examiner

*Primary Examiner* — S. Joseph Morano
*Assistant Examiner* — Andrew Polay
(74) *Attorney, Agent, or Firm* — Polsinelli PC; Michael Williamson

(57) ABSTRACT

An adjustable skeg has a body formed by sidewalls including a closed bottom or base. The sidewalls converge to form a leading edge and a trailing end. The top is generally open and the top and sidewalls define a cavity for receiving a skeg or stub. The skeg may also be of unitary construction with the lower drive unit/gear case of a boat motor. The top and bottom portions of the trailing end project rearwardly to form extensions beyond a central portion of the trailing end. A torque vane is pivotally mounted between the top and bottom extensions. The vane is pivotable to subtend a preselected angle with a respective sidewall for eliminating steering torque. A plurality of receivers is positioned on either the top or bottom extension for locking the vane in place following adjustment. The receivers are identified by respective indicia for calibrating adjustment of the torque vane.

16 Claims, 4 Drawing Sheets

ADJUSTABLE SKEG

FIELD OF INVENTION

The present invention is broadly concerned with a marine skeg. More particularly, it is directed to an improved skeg having an adjustable vane that may be used to counteract steering torque. The invention also relates to boat motors having an integrated adjustable skeg.

BACKGROUND

The housing of the lower drive unit, or gear case, of modern outboard motors is configured to include a plate that projects above the propeller and helps to reduce the amount of surface air and/or exhaust drawn into the propeller blades. This anti-ventilation plate typically includes a dependent trim or torque tab that may assist in controlling steering imbalance or torque.

Some steering torque may occur when an engine with a right-handed propeller is trimmed in, because this causes the propeller shaft to tilt upwardly at the aft end, which increases the pitch of the downward blade on the right side of the shaft. In recent years, the manufacturers of marine outboard or stern drive motors have increased the recommended mounting height for their engines. The raised propeller may break the surface of the water, especially when the boat is trimmed in. Under these circumstances, a right-handed propeller tends to push the stern to the right, rotating the boat along with it in a right-handed turn unless counteracted at the wheel. This so-called "propeller walk" or "paddle-wheel" effect is not limited to propellers on engines raised above the standard installation height. It may also occur when a boat is operated at high speed, in waves or if the boat pitches. It may be a moderate effect, or it may outweigh all other causes of steering torque, and it may adversely affect steerability.

Steering torque is normally counteracted by using the trim tab to help steer the engine back to a forward course. However, since the trim tab sits on the antiventilation plate above the propeller, in a raised engine the trim tab may also have been raised above the water line, or to a height that impairs its effectiveness in altering steering torque.

The gear case also projects below the propeller in the form of a dependent fin. This so-called skeg portion is thus always positioned below the propeller in the water. The skeg serves to protect the propeller from striking submerged objects or the bottom surface. It may also function as a fixed rudder to assist in steering.

A variety of torque tabs or plates have been developed for attachment to the skeg to compensate for steering torque. Because these skeg tabs are subject to substantial force of water from the rotating propeller blades, they cannot be adhesively attached to the skeg. Instead, they must be fixed in place by means of fasteners inserted into holes that are drilled into the body of the skeg. Placement on one side of the skeg addresses right-hand steering torque, while placement on the other side of the skeg addresses left-hand steering torque. Because placement is dependent on a number of variables such as propeller configuration, engine mounting height, engine trim angle, engine horsepower and speed, it is difficult to determine a proper placement for the tab or plate prior to attachment to the skeg. Repositioning of the skeg tab, either to switch handedness or to adjust its location on the same side, requires removal of the fasteners, drilling new holes in the body of the skeg, and refastening the tab. This procedure is cumbersome, time consuming, and impractical. Moreover, drilling additional fastener holes in the skeg weakens it, and may ultimately result in damage that necessitates replacement of the skeg.

Because of the downward projection of the skeg, it is subject to damage and breakage from encounters with submerged objects such as stumps, gravel, rocks and the like. Damaged metal skegs may be repaired by welding, but such repair is labor intensive, costly and once repaired, the skeg remains subject to continued damage. Polymer and composition skegs cannot generally be mended, and alternate replacement of the entire lower gear case is not cost effective. Thus, damaged skegs can commonly be restored by fastening a replacement shell over the stub of the original skeg.

There is a need for a marine skeg having an adjustable vane structure for reducing or eliminating steering torque, that is positioned on the gear case at or below the level of the propeller so as to remain submerged with the propeller and maintain steering torque reduction regardless of the mounting height of the engine on the boat, the trim of the boat, or the water conditions, that can be easily adjusted without the need for removal of the skeg, that has an adjustable vane structure that, when fixed, helps to act as a fixed rudder to assist in steering control and that can be adjusted to eliminate either right-handed or left-handed steering torque, that further can be repeatedly readjusted and fixed in place to compensate for different boating situations, that can be repeatedly readjusted without drilling additional holes in the skeg, that can be configured as an integral part of the gear case of a motor or as a replacement skeg for fitting over an existing skeg or skeg stump, and that is economical to construct, durable and simple to operate.

SUMMARY OF THE INVENTION

The present disclosure provides a greatly improved adjustable skeg for attachment to the lower drive unit or gear case of a boat motor. The skeg may also be of unitary construction with the gear case. The skeg includes a body formed by a pair of sidewalls connected at a leading edge and a trailing end. The body is closed at the bottom or by connection to a base and the top is generally open to permit attachment over the stub of an existing skeg. The top and bottom portions of the trailing end project beyond the central portion of the trailing end to form a pair of extensions. A torque vane is pivotally connected to the trailing end between the top extension and the bottom extension. A fastener is provided for removably fixing the torque vane to the bottom extension. The upper surface of the bottom extension includes a plurality of spaced apart receivers for accepting the fastener when the torque vane is positioned.

In one embodiment, the upper surface of the bottom extension includes a recessed indicia block. The indicia provide means for objective identification of the angular orientation of the torque vane with respect to the body of the skeg and enable precise tracking and calibration of torque vane adjustments.

In one embodiment, the bottom extension is configured to include a convex upper surface. This provides clearance for the bottom trailing edge of the torque vane when the torque vane is positioned to subtend an angle with respect to the body of the skeg.

In one embodiment, the bottom is configured to have the general form of a dependent fin having a generally triangular cross section.

In one embodiment, the skeg bottom is closed by connection of the sidewalls and the bottom portion of the trailing end projects rearwardly to form an extension. The torque vane is pivotally connected between the top and bottom extensions.

In another embodiment, the skeg bottom is closed by connection of the sidewalls to a base, which projects rearwardly to form an extension. The torque vane is pivotally connected between the top and base extensions.

Various objects and advantages of this adjustable skeg will become apparent from the following description taken in conjunction with the accompanying drawings wherein are set forth, by way of illustration and example, certain embodiments of this improved skeg.

The drawings constitute a part of this specification, include exemplary embodiments of the adjustable skeg, and illustrate various objects and features thereof.

DETAILED DESCRIPTION OF THE INVENTION

As required, detailed embodiments of the adjustable skeg are disclosed herein; however, it is to be understood that the disclosed embodiments are merely exemplary of the device, which may be embodied in various forms. Therefore, specific structural and functional details disclosed herein are not to be interpreted as limiting, but merely as a basis for the claims and as a representative basis for teaching one skilled in the art to variously employ the apparatus in virtually any appropriately detailed structure.

Figure 1:
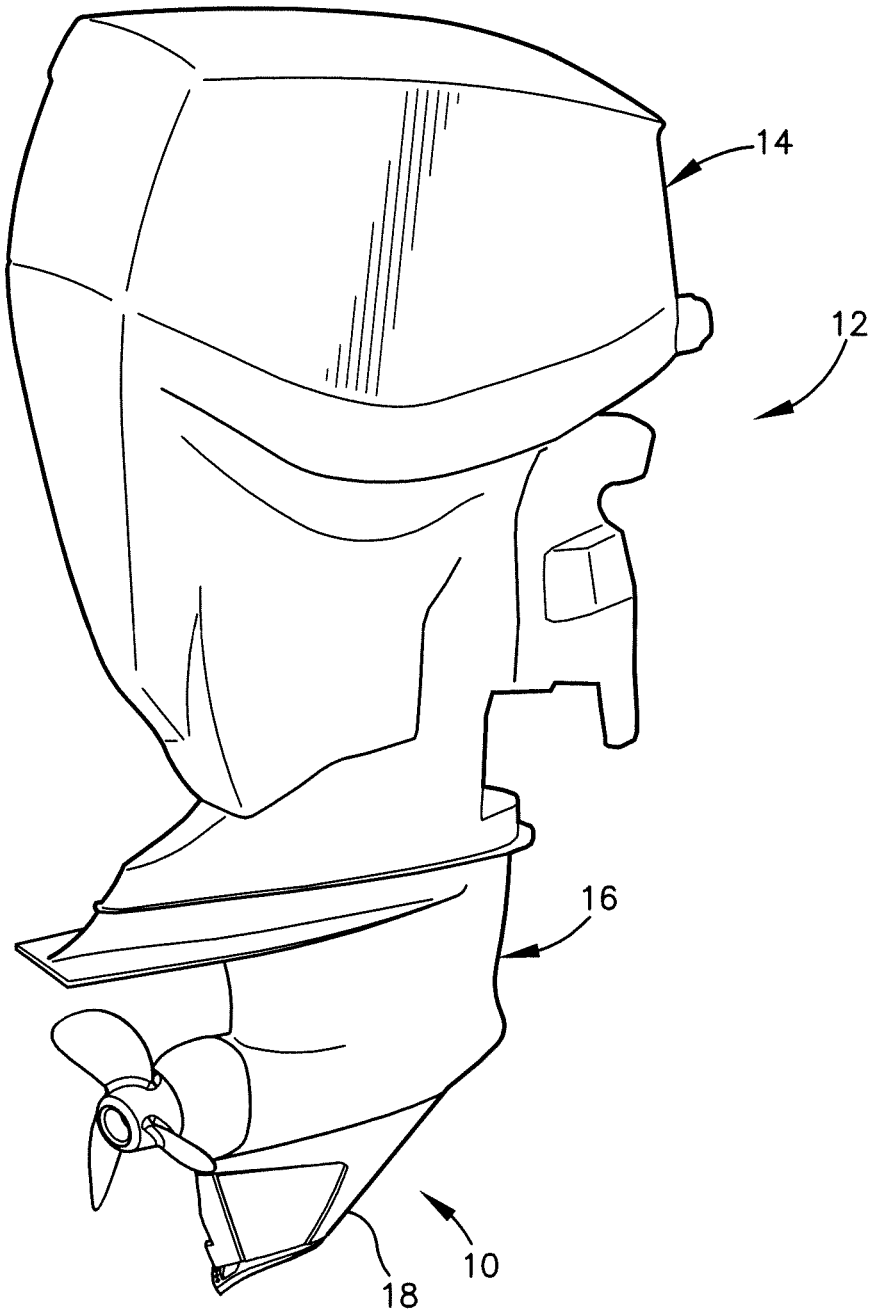
FIG. 1 is a side perspective view showing a skeg in accordance with the invention on the lower drive unit of a conventional outboard boat motor.

The reference numeral 10 refers to an adjustable skeg, which is depicted in FIG. 1 in association with a marine motor 12, having an attached housing or protective engine cover 14 which contains an engine (not shown), and a lower drive unit, gear housing or gear case 16. The illustrated boat motor 12 is an outboard motor, however, those skilled in the art will appreciate that the adjustable skeg may be used in association with other types of marine motors, including, for example, inboard/outboard and inboard units.

Figure 2:
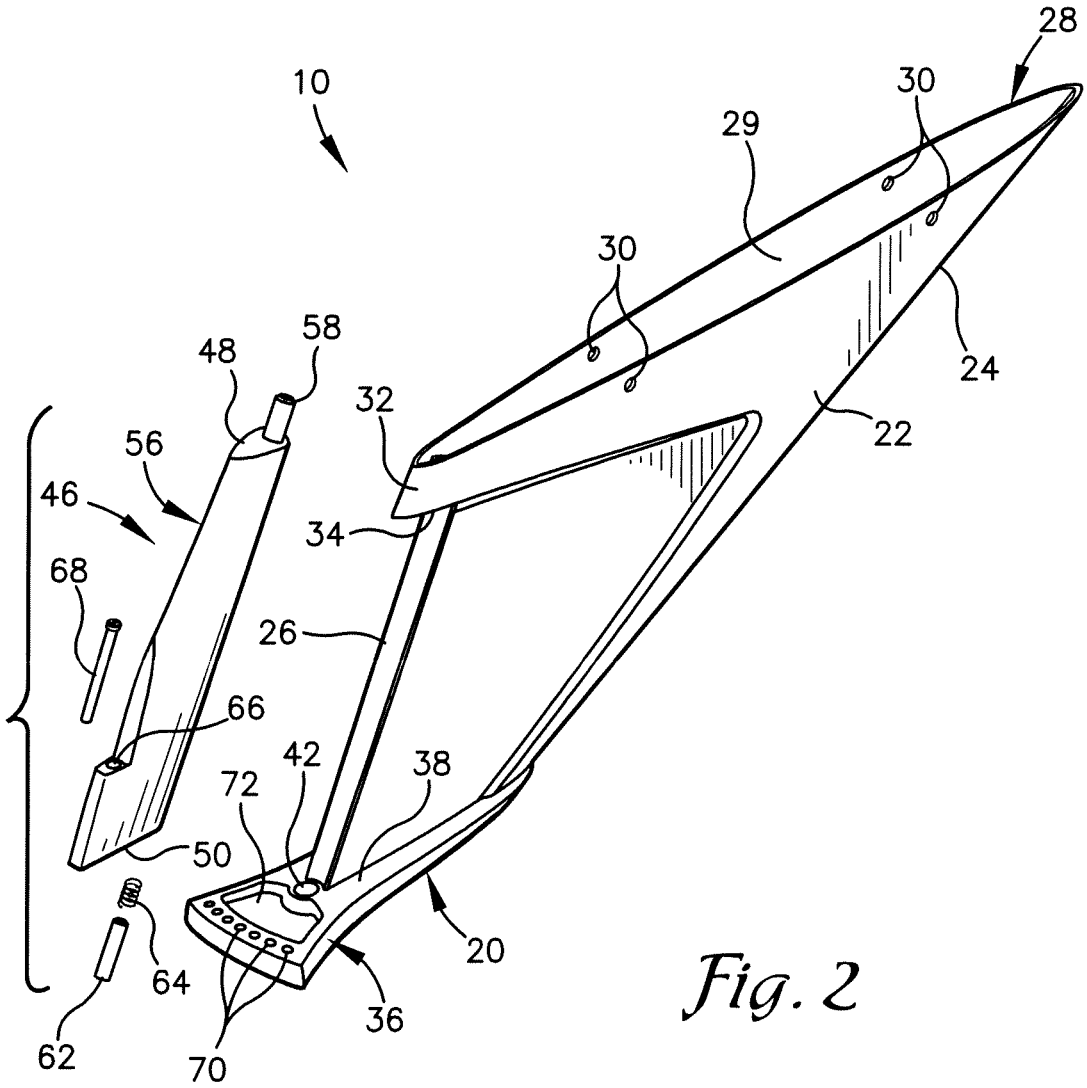
FIG. 2 is an enlarged, exploded perspective view of a removable skeg.
Figure 3:
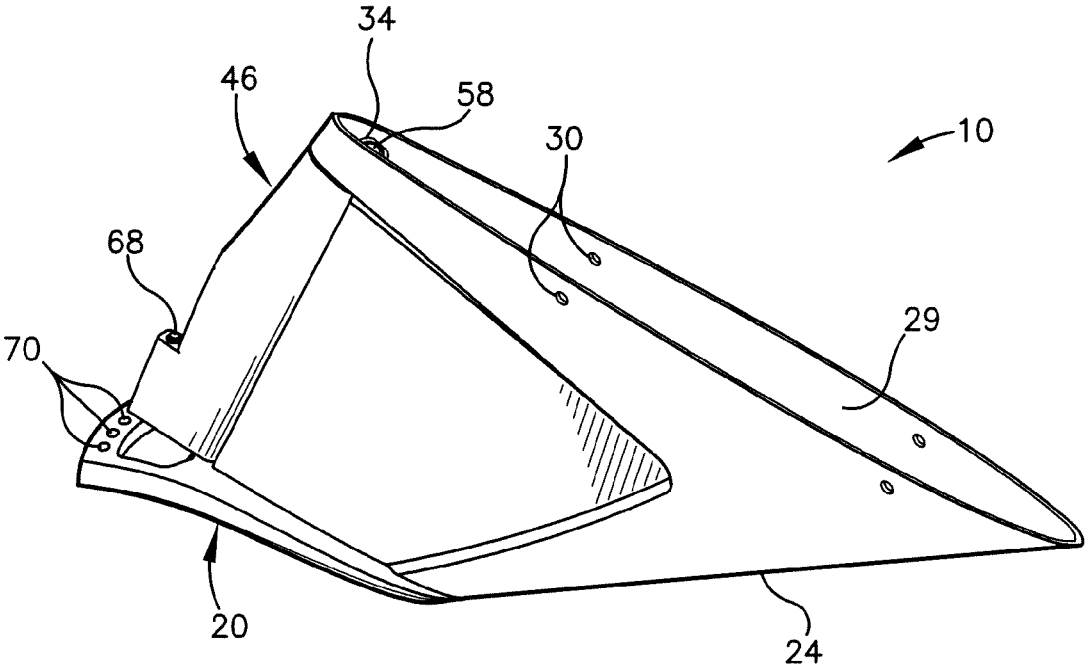
FIG. 3 is an enlarged perspective view of the skeg from above showing the open top.
Figure 5:
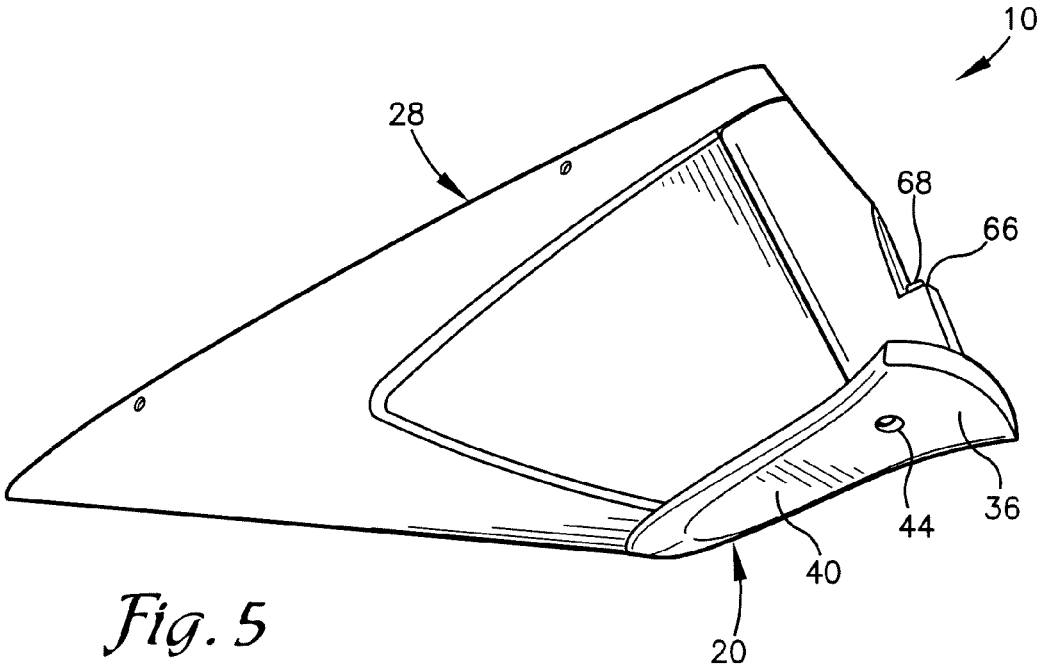
FIG. 5 is an enlarged perspective view showing details of the skeg bottom.

The skeg 10 has the overall configuration of a dependent fin and is sized to project downwardly from the lower drive unit/gear case 16 on the inboard side of the propeller, so that it will not interfere with operation of the blades. The skeg includes a body 18 having a generally closed bottom or base 20 (FIGS. 2, 5). The body 18 is formed by a pair of spaced apart sidewalls 22 that may be of integral construction with the bottom or base 20, or the sidewalls 22 may be connected to form a bottom or base 20. The base may also be separately constructed and fixedly connected to the body 18, as by welding or soldering, or it may be removably connected by fasteners or the like. The sidewalls 22 converge to form a forward nose or leading edge 24 and are also connected at the back to form a trailing end 26 (FIG. 2). While the trailing end 26 is illustrated in the form of an edge formed by convergence of the sidewalls 22, it may also comprise an end wall interconnecting the sidewalls 22 or the sidewalls 22 may be formed or bent near the area of the connection to form a curved or flat surface on the trailing end 26. The skeg body 18 and base 20 may be constructed as single structure, or they may comprise two or more separate components which are connected to form the skeg structure 10, for example, two sidewalls 22 that form a closed bottom or base 20 when connected, two sidewalls 22 and a base 20, or a single unitary sidewall 22 and a base 20. The sidewalls 22 may be constructed as mirror images, or one sidewall may include a lip that forms a leading edge 24 when it is connected to the other, correspondingly shortened, sidewall.

The skeg body 18 has a generally open top 28. The top 28 may be generally straight across, as shown in the drawing figures, or it may be curved upwardly at the forward end, or it may be configured in any other suitable shape to fit over the skeg of a boat motor. The top 28 and the sidewalls 22 cooperatively define an interior cavity or slot 29 that is sized and shaped to permit installation of the improved skeg 10 over an existing skeg or the stub of a broken skeg. A plurality of spaced apertures 30 are provided for reception of fasteners (not shown) therethrough for attachment of the skeg to the stub. An adhesive substance may also be used, either alone or in combination with fasteners to attach the skeg.

In another embodiment, the skeg 10 is of unitary construction with the lower drive unit or gear case 16 of a boat motor, so that together the gear case 16 and skeg 10 form a single component or unit. The single unit may also be constructed so that the skeg portion 10 is of generally solid construction, or generally multicelled, or partially filled and/or internally reinforced, since the cavity 29 is not required. The skeg may also be fixedly connected to the lower drive unit 16 by permanent fasteners, for example by rivets or welding. The top portion 28 of the trailing end 26 projects rearwardly, beyond a central portion of the trailing end to form a top extension portion, arm or flange 32. The top extension 32 is generally configured to continue the rearward convergence of the sidewalls 22, although it may also have any other suitable geometric configuration. The top extension 32 includes an aperture, recess or socket that opens 34 on the lower surface for receiving a pivot member or pin to be described.

The skeg bottom or base 20 is illustrated in the form of a generally triangular or wedge-shaped plate that includes a rearward extension portion 36 projecting beyond a central portion of the trailing end 26 of the skeg body. It is foreseen, however, that the base 20 may be of any other suitable shape, such as, for example, a quadrilateral, multilateral, rounded, curvate or mixed-geometric shape. The base 20 may also be configured to project outboard of the sidewalls along either a portion or the entire length thereof. Such a wide bottom configuration serves to protect the skeg 10 from damage. Where the skeg bottom is closed by connection of the sidewalls or the bottom or base is of integral construction with the sidewalls 22, the bottom portion of the trailing end 26 may project rearwardly to form a bottom extension 36, or a separately constructed bottom extension 36 may be attached to the trailing end 26.

The base 20 and bottom extension 36 each include an upper or top surface 38 and a lower or bottom surface 40 (FIG. 5). The extension 36 includes an aperture, recess or socket 42 having an opening on the top surface 38 (FIG. 2) for receiving a pivot member or pin to be described. The bottom surface 40 also includes an aperture or weep hole 44 (FIG. 5) to permit moisture to escape.

The bottom surface 40 of the base 20 is illustrated to have a generally concave profile when viewed along the longitudinal axis of the skeg (FIG. 6), although it may also be generally planar or flat. The bottom surface 40 may also include a dependent fin portion 41, shown in phantom in FIG. 6, giving the base 20 an approximately triangular profile when viewed along the longitudinal axis.

As best shown in FIG. 2, a torque vane 46 includes a top 48, a bottom 50, a pair of spaced apart sidewalls 52, a leading edge 54 and a trailing edge 56. The torque vane top 48 includes a fixed pivot pin 58 for reception in the socket 34. The torque vane bottom 50 includes a socket 60 for receiving a pivot pin 62. The pivot pin is spring loaded by a coil spring 64, which is inserted into the socket 60 before the pivot pin 62, thereby enabling the pin to be depressed and the lower part of the torque vane 46 to be moved over the upper surface 38 of the base or bottom extension 36 until the pin 62 is positioned directly above the socket or recess 42. When the pin 62 reaches the socket 42, the spring biases it into locking engagement with the socket 42. In this manner, the pins 58 and 62 pivotally secure the torque vane 46 between the top and base extensions 32 and 36.

The structure and arrangement of the fixed and spring-biased pivot pins on the torque vane 46 may be reversed, so that the fixed pin 58 is on the bottom and the spring-biased pin 62 on the top. The torque vane 46 may also be connected to the surface of one or both of the sidewalls 22 of the skeg rather than between the top extension 32 and bottom extension or base 36. In one embodiment, the top extension 32 and base or bottom extension 36 may be omitted and the torque vane pivotally mounted between receivers connected to the trailing end 26 or to one or both of the sidewalls 22. It is also foreseen that gudgeons and pintels may be substituted for the sockets 34 and 42 and pivot pins 58 and 62, or that the torque vane 46 may include a longitudinal bore for receiving a single elongated pivot member that extends outwardly from either end of the bore for reception in the sockets 34 and 42. It is further foreseen that, in alternate embodiments, the torque vane 46 may be hingedly connected to the skeg by one or more hinge members (not shown), which may be attached to the trailing end 26 or to one or both sidewalls 22. In hinged embodiments, the torque vane pivots about the hinge pin(s), eliminating the need for pivot pins formed or received on the ends of the torque vane.

The lower portion of the trailing edge 56 of the torque vane includes a relief area 67 to provide access to a hole or receiver 66 for a pin or fastener 68 (FIG. 6) that cooperatively form locking structure for fixing or locking the torque vane in a selected angular orientation. The upper surface of the base 38 includes a plurality of spaced apart recesses or receivers 70. The fastener 68 and receivers 70 are preferably threaded for mating engagement, however, any suitable fastening system may be employed with correspondingly configured receivers, such as, for example, a spring-loaded pin, slide lock, or latch. Alternatively, the receivers 70 and pin 68 may be replaced by an elongated lateral slot or guide formed or positioned in the bottom extension or base 36 and contiguous with a plurality of spaced apart, orthogonally positioned receivers or keyholes for sliding reception of a constrained pin. In certain embodiments, the locking structure may be incorporated into the pivot structure, for example in a locking hinge.

When the torque vane is positioned to subtend a preselected angle with one of the skeg sidewalls 22, the fastener 68 is tightened into locking engagement with a selected one of the receivers 70. Alternatively, a spring loaded pin (not shown) may be biased into locking engagement with a receiver 70, or the latch of a slide lock may be urged into locking engagement with an appropriately configured receiver 70. It is foreseen that the receivers 70 could alternatively be positioned on one or both of the skeg sidewalls 22 and the fastener 68 could be positioned for insertion through the torque vane 46 and into the receivers.

Figure 4:
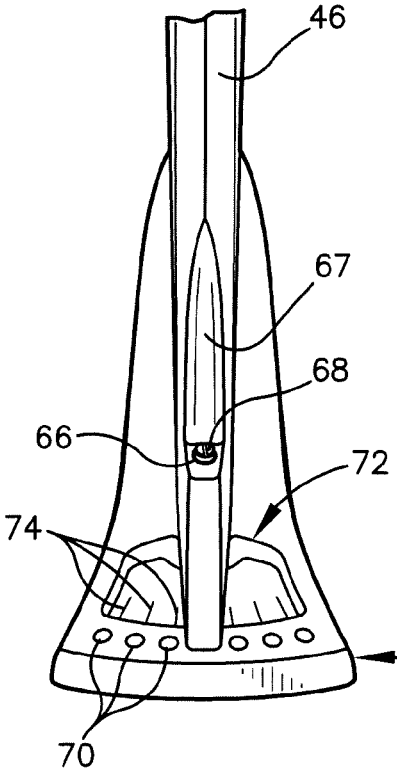
FIG. 4 is an enlarged, partial rear elevational view of the skeg showing details of the calibration system.

A calibration system is provided in the form of an indicia block 72 having a series of spaced apart indicia 74 (FIG. 4). The indicia block 72 is positioned adjacent and preferably forward of the receivers 70, although it may also be positioned rearwardly of the receivers 70, or on the lower surface 40 of the bottom extension or base 36. The indicia block 72 includes an array of a plurality of spaced apart indicia 74, each uniquely identifying one of the receivers. The block 72 may be recessed somewhat below the surface 38 of the base to protect the indicia from wear and to provide clearance for an applied protective coating. The indicia may be used to calibrate the effect of positioning the fastener 68 in a particular receiver 70 when the skeg 10 is used under particular conditions and to enable the user to select a receiver for adjustment of the torque vane 46 in accordance with the desired torque adjustment.

Figure 6:
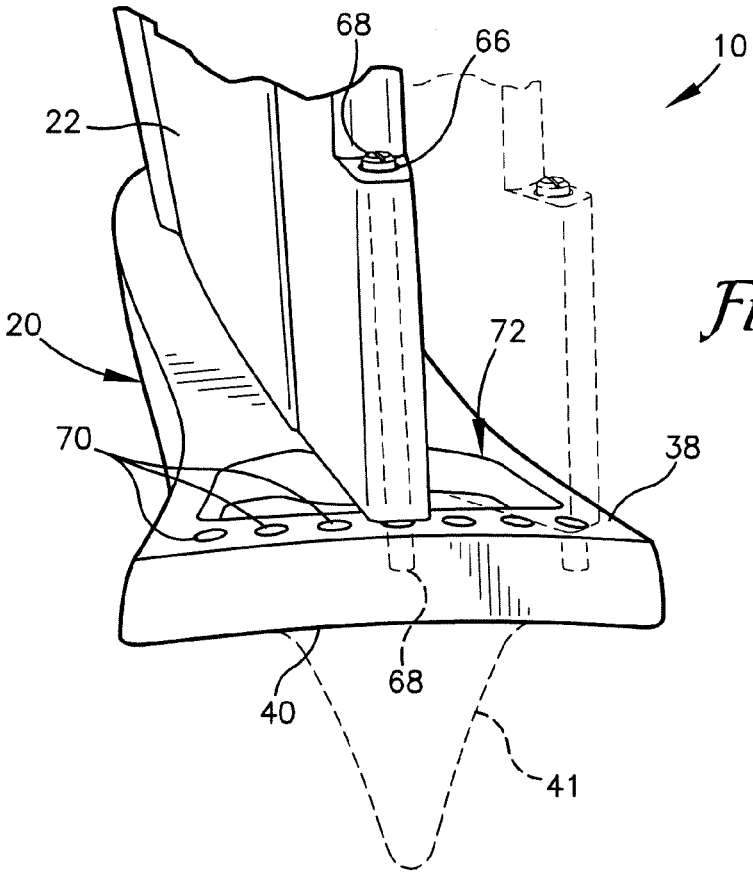
FIG. 6 is a greatly enlarged partial rear perspective showing details of the torque vane locking structure.

As shown in FIG. 6, when viewed along the longitudinal axis of the base 20, the upper surface 38 is slightly convex. This provides additional clearance to compensate for the lowering of the torque vane bottom 50 against the upper surface 38 of the base that occurs as a result of the altered angular orientation of the torque vane as it pivots and travels along the outboard receivers 70. This occurs when the torque vane 46 is pivotally adjusted in order to subtend an angle of less than about 180° with one of the respective sidewalls 22.

In one embodiment, the top extension 32 that extends rearwardly from the sidewalls 22 of the skeg is configured to have a shape similar to the shape of the base 20 shown in FIG. 6. In such an embodiment, the top extension 32 includes a lower surface with sockets and an indicia block, enabling the torque vane to be adjusted by positioning the fastener 68 in a selected receiver 70 by pivoting the torque vane about the pins 58 and 62.

In one embodiment, the receivers 70 are bored through either or both of the top and bottom extension 32 and 36. In such embodiments, it is foreseen that the indicia block 72 may be positioned on either or both of the top and bottom surface of the respective extensions 32 and 36.

The skeg body 18 and base 20 are preferably of metal construction, for example aluminum, steel or an alloy, particularly when the skeg 10 is of unitary construction with a metal housing of the lower drive unit/gear case of a boat motor. The skeg body and base may also be constructed of a synthetic resin material, fiberglass, or any other suitable material or combination thereof. The sidewalls 22 may have a generally smooth profile as shown in FIG. 1, or they may include fins or grooves to facilitate passage of the skeg 10 through the water.

In use, the skeg 10 is installed on the lower drive unit/gear case 16 of a boat motor 12 by sliding the open top 28 over the factory skeg or the stub of a broken skeg, which is received within the cavity 29. The skeg 10 is secured in place by inserting fasteners through the apertures 30. Optionally, a quantity of an adhesive may first be applied to the mating surfaces. A user pivots the torque vane 46 about an axis defined by the extensions 32 and 36 to adjust the angular orientation of the torque vane 46 so that it subtends a preselected angle with regard to one of the skeg sidewalls 22. The angle of orientation of the torque vane 46 required to counteract the force of the steering torque is determined in accordance with the speed and power of the engine, the configuration of the propellers and other known variables. The direction of orientation of the torque vane 46 is determined based on the direction of motion of the propellers. The angle of the torque vane 46 may be determined in accordance with a predetermined published schedule, or it may be ascertained by trial and error. Once the direction is chosen and the angle selected, the torque vane 46 may be adjusted with reference to the indicia block 72, wherein each of the array of receivers 70 is labeled. Each receiver 70 corresponds to an angular orientation of the torque vane 46 when the fastener 68 is inserted in the respective receiver 70. Once the fastener 68 is tightened in engagement with a preselected receiver to lock the torque vane 46 in place, the craft is operated at the selected speed to asses steering torque. If the torque has not been entirely eliminated, the fastener 68 may be backed out of the receiver 70 and the torque vane 46 moved to another receiver 70 and secured in the manner previously described. Such adjustment may be undertaken any number of times.

The skeg 10 is of universal construction and may be repeatedly removed from the lower drive unit 16 of one engine 12 and installed on another. In this manner, the torque vane 46 of the improved adjustable skeg 10 may be adjusted, locked in place, readjusted and locked in place any number of times to eliminate steering torque in association with a wide variety of propellers and engines without the need to redrill the underlying skeg or stub over which it has been installed.

In another manner of use, the skeg body 18 and the lower drive unit/gear case 16 are of unitary construction forming a single integrated unit that is connected with the engine cover 14 of the boat motor 12. A user pivotally adjusts the torque vane 46 to a selected torque-compensating angular orientation with reference to the indicia 74, and locks it in place as previously described. If necessary, the user unlocks the torque vane 46 and repositions it to adjust the angular orientation with reference to the indicia 74, and again locks it in place.

It is to be understood that while certain forms of the adjustable skeg have been illustrated and described herein, the invention is not to be limited to the specific forms or arrangement of parts described and shown.

The following is claimed and desired to be secured by Letters Patent:

1. A skeg for attachment to the lower drive unit of a boat motor, comprising:

a. a pair of spaced apart sidewalls;

b. the sidewalls are connected to form a body having a leading edge, and a trailing end;

c. the body further includes upper and lower extension portions that extend rearwardly beyond the trailing end;

d. the body has an open top and closed bottom;

e. a vane is pivotally connected to the trailing end; and f. a repositionable fastener on the lower extension to enable pivotal adjustment of the vane.

2. The skeg of claim 1, wherein the trailing end includes a plurality of spaced apart recesses for receiving the fastener.

3. The skeg of claim 2, wherein the trailing end includes a plurality of indicia identifying the recesses for receiving the fastener.

4. The skeg of claim 1, wherein a portion of the trailing end forms a bottom extension having a convex upper surface.

5. The skeg of claim 1, wherein a dependent fin portion is connected to the bottom.

6. The skeg of claim 1, wherein the body includes a plurality of apertures in spaced relation to the open top for fastening the skeg to the lower drive unit.

7. A skeg that is attachable to the lower drive unit of a boat motor, comprising:

a. a body having a pair of sidewalls connected at a leading edge, a bottom and a trailing end;

b. the body includes upper and lower extension portions that extend rearwardly beyond the trailing end;

c. a vane is pivotally connected between the upper and lower extensions;

d. a fastener connects the lower extension with the vane; and e. the fastener is repositionable on the lower extension to enable pivotal adjustment of the vane.

8. The skeg of claim 7, wherein the lower extension includes a plurality of spaced recesses for receiving the fastener.

9. The skeg of claim 8, wherein the lower extension includes a plurality of indicia identifying the recesses for receiving the fastener.

10. The skeg of claim 7, wherein the fastener connects the vane to the top extension and is repositionable on the top extension to enable pivotal adjustment of the vane.

11. The skeg of claim 8, wherein the lower extension includes a convex upper surface.

12. The skeg of claim 8 wherein the lower extension includes a dependent fin portion.

13. A boat motor comprising:

a. an engine;

b. a lower drive unit attached to the engine, the lower drive unit including a propeller and a skeg;

c. the skeg comprising a sidewall forming a body, wherein the body includes a leading edge, a trailing end and a closed bottom, the body further includes upper and lower extension portions that extend rearwardly beyond the trailing end;

d. a repositionable vane is pivotally connected to the body; and e. a fastener on the lower extension connects the repositionable vane to the trailing end.

14. The boat motor of claim 13, wherein the trailing end includes a bottom portion having:

a. a plurality of spaced recesses for receiving the fastener; and b. a plurality of indicia identifying the recesses for receiving the fastener.

15. The boat motor of claim 13, wherein the bottom includes a convex upper surface and a dependent fin portion.

16. A method of using an adjustable skeg attached to the lower drive unit of a boat motor, the skeg including a body having a pair of sidewalls connected at a leading edge, a bottom edge and a trailing end, the body having upper and lower extension portions that extend rearwardly beyond the trailing end, a vane pivotally connected between the upper and lower extension portions, and a fastener for connecting the vane to the lower portion, the method comprising:

a. unfastening the vane from the lower extension portion;

b. pivotally rotating the vane between the upper and lower extension portions from a selected angular orientation to a second selected angular orientation; and c. fastening the vane to the lower extension portion at the second selected angular orientation.

* * * * *